United States Patent [19]

Allen et al.

[11] Patent Number: 4,498,504

[45] Date of Patent: Feb. 12, 1985

[54] FILLING FRINGE WASTE REDUCTION

[75] Inventors: Danny H. Allen; John H. Sumner, both of Greensboro, N.C.

[73] Assignee: Burlington Industries, Inc., Greensboro, N.C.

[21] Appl. No.: 421,730

[22] Filed: Sep. 23, 1982

[51] Int. Cl.[3] ..... D03D 47/40; D03D 49/70

[52] U.S. Cl. ..... 139/302; 139/194; 139/430; 139/435

[58] Field of Search ..... 139/302, 303, 263, 266, 139/170.4, 435, 194, 430

[56] References Cited

U.S. PATENT DOCUMENTS

| | | | |
|---|---|---|---|
| 2,080,784 | 5/1937 | Pool . | |
| 3,198,216 | 8/1965 | Ancet et al. . | |
| 3,258,038 | 6/1966 | Ancet et al. . | |
| 3,376,903 | 4/1968 | Golobart . | |
| 3,455,342 | 7/1969 | Golobart . | |
| 3,580,293 | 5/1971 | Fransen | 139/303 |
| 3,665,976 | 5/1972 | Freihofer . | |
| 3,901,286 | 8/1975 | Vermeulen et al. | 139/435 |
| 3,951,177 | 4/1976 | Santucci . | |
| 4,040,452 | 8/1977 | Santucci | 139/302 |
| 4,178,971 | 12/1979 | Malasek et al. . | |
| 4,185,667 | 1/1980 | Kendrick . | |
| 4,275,773 | 6/1981 | Shibata | 139/302 X |

FOREIGN PATENT DOCUMENTS

| | | | |
|---|---|---|---|
| 2271320 | 12/1975 | France | 139/302 |
| 2374450 | 7/1978 | France | 139/302 |
| 7704471 | 10/1978 | Netherlands . | |
| 2009798 | 6/1979 | United Kingdom . | |

*Primary Examiner*—James Kee Chi

*Attorney, Agent, or Firm*—Cushman, Darby & Cushman

[57] ABSTRACT

A structure for weaving without outer leno yarns on an air jet loom eliminates the auxiliary selvage from both sides of the fabric being woven. A mechanical filling yarn clamp is disposed between the filling detector and suction source on the right-hand side of the loom for holding the ends of the picks during weaving. A suction source nozzle is mounted adjacent and exterior of a fringe cutter downstream of the temples on the right-hand side for removing pick trimmings cut by the fringe cutter. A combined clamp and cutter is mounted on the left-hand side of the loom adjacent the fabric edge to provide acceptable fringe length without subsequent trimming.

17 Claims, 13 Drawing Figures

Fig. 11.
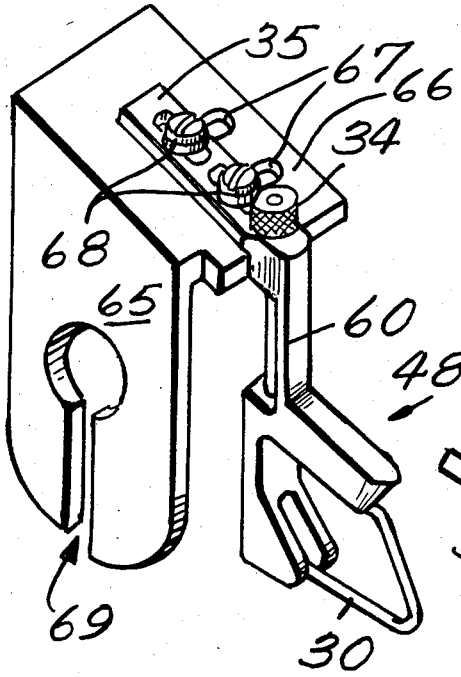
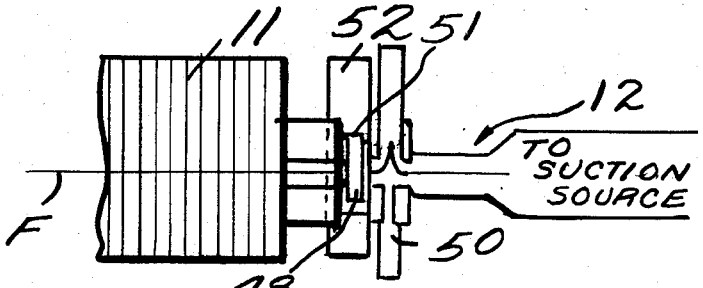
Fig. 7.
Fig. 10a.
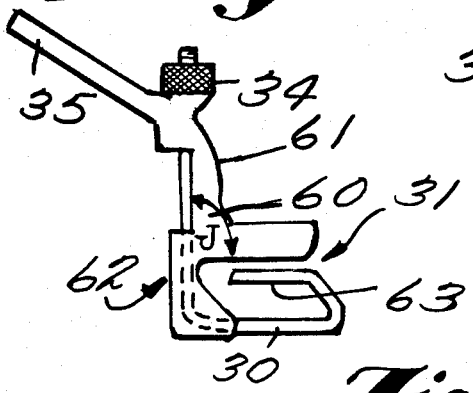
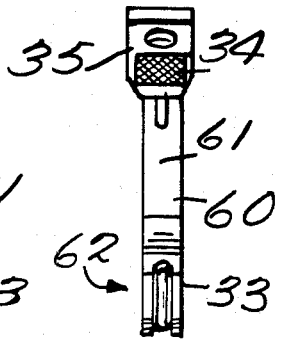
Fig. 10b.
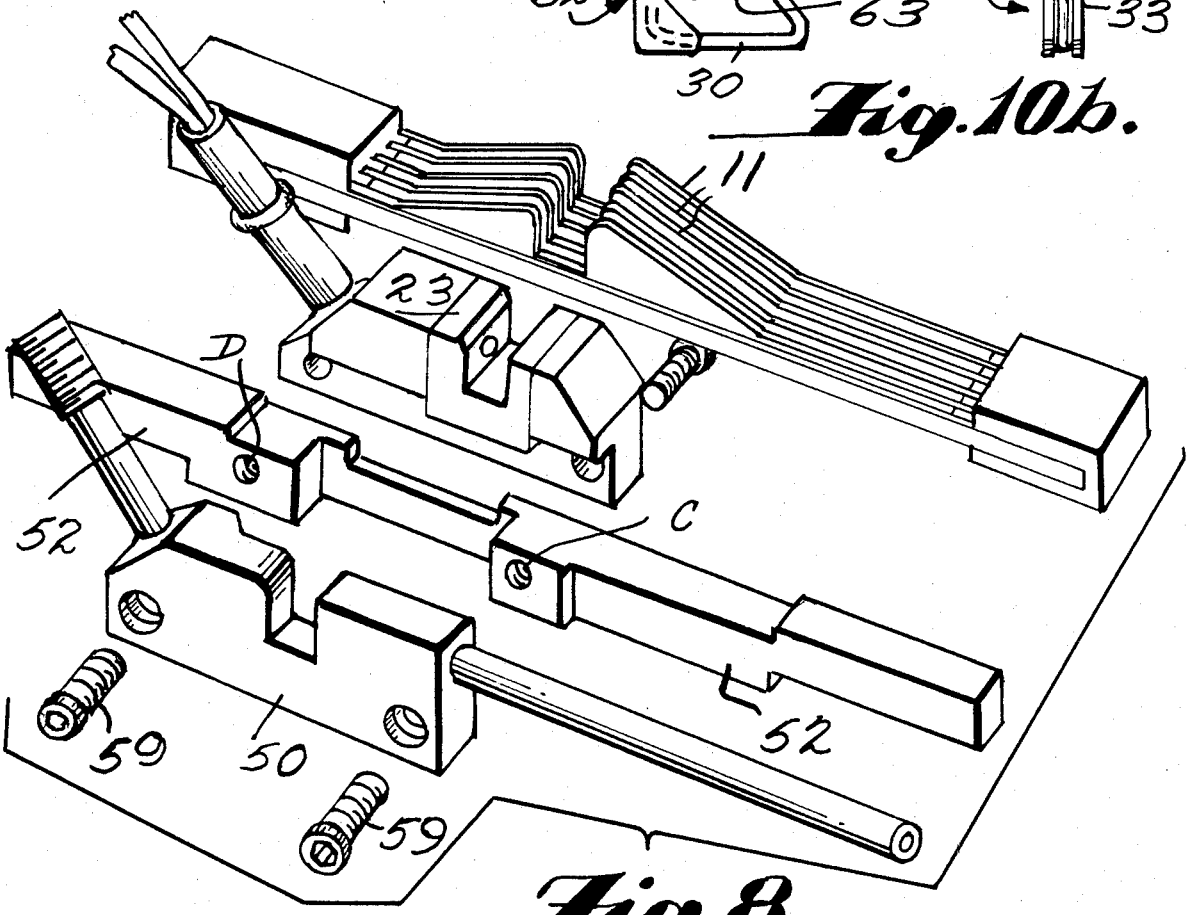
Fig. 8.

FILLING FRINGE WASTE REDUCTION

BACKGROUND AND SUMMARY OF THE INVENTION

Selvage systems are utilized with looms to hold the loose filling yarns extending outwardly from the normal edges of the woven fabric, and to facilitate removal of waste edge yarn of the fabric in an orderly manner to prevent stoppage of the machine, defects in the fabric, or the like. Typically leno selvage systems, such as that for a Ruti L5000 air jet loom, comprise a false selvage system wherein an outer set of leno yarns weave, bind, and carry away the weft fringe waste. Typically the weft fringe waste is shorter on the left side and longer on the right side. An inner set of leno yarns weave at each edge of the fabric, these inner leno yarns staying with the fabric to prevent unravelling at the fabric edge.

Specifically in the Ruti L5000 arrangement there is a skip dent area between outer leno yarns and the inner leno yarns on the reed on the left-hand side of the loom, a primary cutter and distinct clamp are disposed upstream of the loom temple, and a fringe cutter is disposed in a projection of the skip dent area for cutting the outer leno yarns, and associated selvage, from the fabric being woven.

On the right-hand side of the Ruti conventional loom the outer leno yarns are disposed between a filling detector and a stretch nozzle, both located at the end of the reed. A suction source is mounted on the opposite side of the stretch nozzle from the outer leno yarn, and cooperates with the stretch nozzle to provide sufficient filling yarn tension. The outer leno yarn, as on the left side, serves to bind and carry away the weft trim fringe, a fringe cutter being disposed in a projection of the area occupied by the filling detector downstream of the temple.

The utilization of a conventional outer leno selvage system, such as on the Ruti L5000 air jet loom, results in a large amount of waste, and less than ideal production efficiency since the outer leno yarns also cause loom stoppage due to breakage, tangling, etc., thereof.

According to the present invention an apparatus and method are provided for completely eliminating both the left and right outer leno yarns in a conventional air jet loom, and providing about a 50–65% reduction in the filling fringe waste. This is accomplished with no decrease in efficiency of the waste removal and as a matter of fact production efficiency increases since the outer leno yarns—which often cause loom stoppage—are eliminated. Further, various structures associated with the conventional air jet loom are simplified or eliminated, with the ultimate result being a much more efficient, yet simple, system.

The desirable results achieved according to the present invention are accomplished by providing a combined primary cutter and clamp on the left side of the loom. The fringe cutter, the skip dent area in the reed, and the outer leno yarns are eliminated by the simple act of combining the primary cutting and clamping functions; also the space between the cutting point and the reed edge is substantially reduced. Thus the fabric edge is placed at the end of the reed so that the distance from the primary cutting point to the end of the reed is reduced, achieving an acceptable fringe length so that there is no need for the fringe cutter.

The desirable objectives according to the present invention are further accomplished by modifying the right selvage components of the loom to eliminate the outer leno yarns. While the reed and filling detector remain the same, they are associated with structures that provide cooperation with a clamp to take the place of the outer leno yarns in holding the ends of the picks in place (i.e., retained in tension) so that the fabric edge is woven tightly without looseness or kinks. Since no outer leno yarns are provided, the conventional draw-off wheels may be replaced by a suction source adjacent the fringe cutter located downstream of the right temple.

It is the primary object of the present invention to provide a method and apparatus for minimizing the waste associated with an air jet loom outer or auxiliary leno selvage system. This and other objects of the invention will become clear from an inspection of the detailed description of the invention, and from the appended claims.

BRIEF DESCRIPTION OF THE DRAWINGS

FIG. 7 is a frontal schematic view, like that of FIG. 2, showing the right reed end and associated components of the apparatus of FIG. 4;

FIG. 8 is a frontal and right side exploded perspective view of the components of FIG. 7;

FIG. 10*a* is a side view of the right-hand weft clamping mechanism of FIG. 4, and FIG. 10*b* is an end view thereof; and FIG. 11 is a top perspective view of the clamping mechanism of FIG. 9 shown for mounting in association with the right temple.

DETAILED DESCRIPTION OF THE DRAWINGS

Figure 1:
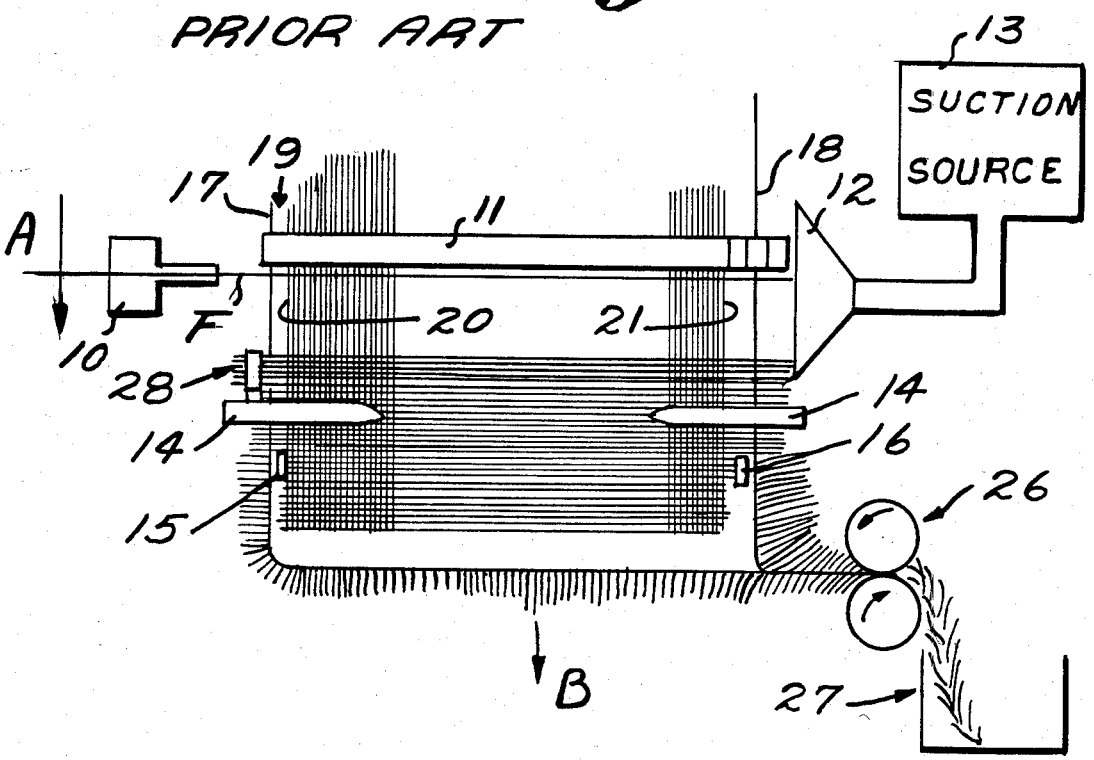
Fig. 1. PRIOR ART
FIG. 1 is a schematic top view of a prior art Ruti L5000 air jet loom auxiliary selvage system, and associated components.
Figure 2:
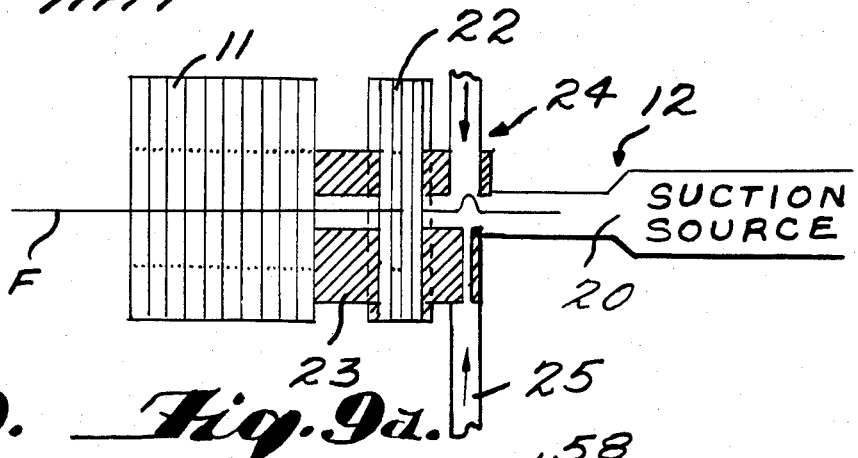
Fig. 2. PRIOR ART
FIG. 2 is a schematic frontal view of the right-hand end of the reed, and associated selvage components, of the apparatus of FIG. 1.
Figure 3:
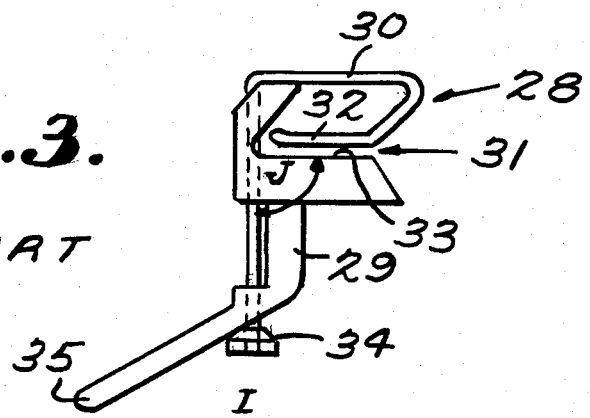
Fig. 3. PRIOR ART
FIG. 3 is a side view of the left-hand clamping mechanism of the prior art air jet loom auxiliary selvage apparatus of FIG. 1.

Components of a conventional Ruti L5000 air jet loom are illustrated in FIGS. 1 through 3. The basic components include a main jet 10 and reed 11 which are mounted to a reciprocating loom lay (not shown) for movement in dimension A, with a suction nozzle 12 connected to suction source 13 disposed on the opposite side of the reed 11 from the main jet 10. Temples 14 are mounted downstream of the reed 11 in the direction of movement B of woven fabric, and left fringe cutter 15 and right fringe cutter 16 are mounted downstream of the temples.

The primary components of the auxiliary selvage system of the prior art air jet loom of FIG. 1 include left outer leno yarns (normally three yarns) 17 and right side outer leno yarns (usually three yarns) 18. A skip dent area 19 is provided at the left end of the reed 11 between the outer leno yarns 17 and the inner leno yarns 20, which inner leno yarns 20 (as well as the right side inner leno yarns 21) weave at the edge of the fabric and stay with the fabric to prevent unravelling of the fabric edges.

The auxiliary selvage system at the right side of the prior art loom of FIG. 1 further includes—see FIG. 2—a short reed section 22 mounted outside the right end of the reed 11 by a conventional Ruti attachment bracket (not shown). The left side of reed section 22 is connected to and supports a conventional filling detector 23, and its right side a stretch nozzle 24, operatively associated with a compressed air conducting conduit 25, which stretch nozzle cooperates with the suction nozzle 12 to tension the weft. The outer leno yarns 18 and associated removed fringe, as well as the outer leno yarns 17 and associated removed fringe, are pulled by draw-off wheels 26 to be ultimately deposited in waste receptacle 27. The filling detector 23, short reed section 22, and stretch nozzle 24 reciprocate with the reed 11 in dimension A—A during the weaving process.

The auxiliary selvage system associated with the left side of the prior art cutter of FIG. 1 further includes a spring clamp structure 28, which is more clearly illustrated in FIG. 3, associated with a separate cutter (not shown). The clamp includes a clamp body 29 with a particularly bent spring wire 30 operatively associated therewith to form a nip 31 between a spring finger 32 of the spring wire and the laterally arcuate surface 33 (see FIG. 10*b*) of the clamp body. An adjustable nut 34 is provided to control the tension of the spring wire 30, and mounting holes are provided in a mounting portion 35 of the clamp body 29 to mount the filling clamp 28 outside the outer leno yarns 17.

Figure 4:
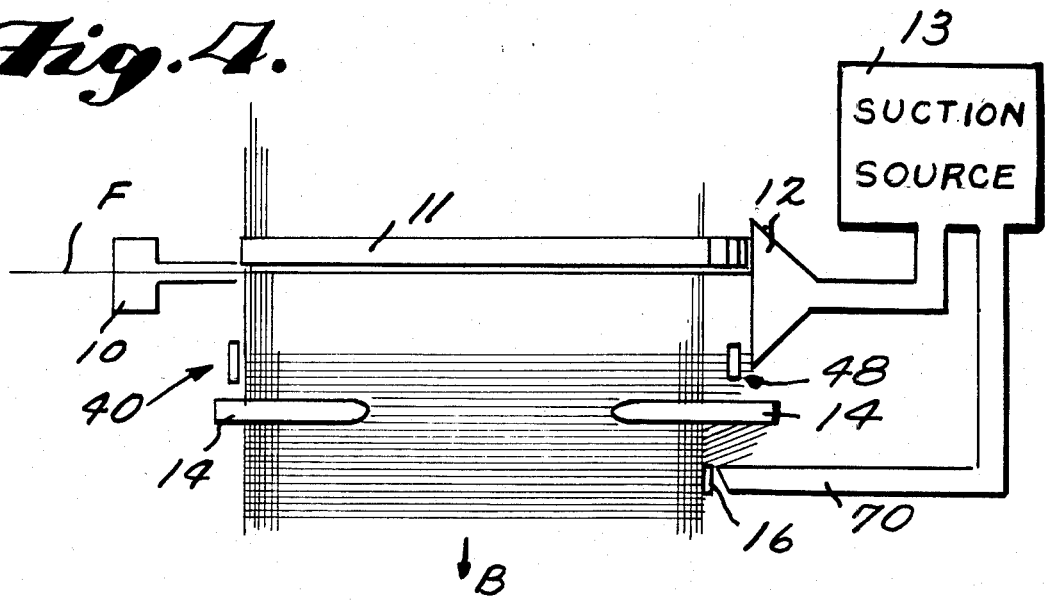
FIG. 4 is a top schematic view like that of FIG. 1 but showing a Ruti air jet loom modified to eliminate the auxiliary selvage system according to the present invention.

An exemplary air jet loom system for eliminating the right and left auxiliary selvages and reducing weft waste according to the present invention is illustrated schematically in FIG. 4. The exemplary inventive structure described in FIGS. 4 through 10 will utilize the same reference numerals for structures substantially the same as the prior art air jet loom illustrated in FIGS. 1 through 3.

As can be seen by an inspection of FIG. 4, the outer leno yarns on both sides of the loom have been eliminated. On the left side of the loom the weft fringe waste is handled by the combined primary cutter and clamp illustrated generally by reference numeral 40, particular attention being directed to FIGS. 4 through 6. The structure 40 combines the functions of the primary cutter and clamp 28 of the prior art air jet loom, and the simple act of combining these functions into a compact integral structure reduces the space between the cutting point and the reed 11 edge. This results in the important unexpected advantages of eliminating the outer leno yarns 17, the skip dent area 19, and the fringe cutter 15, while the length of each filling yarn cut away on the left is reduced by up to about 20 mm. The fringe cutter 15 is eliminated since the placement of the structure 40 so that the primary cutting point is close to the end of the reed 11 achieves an acceptable short fringe length in one step. Thus the simple combination of the primary cutter and clamping functions eliminates several prior art structures without eliminating their functions, and saves a large amount of yarn.

Figure 5:
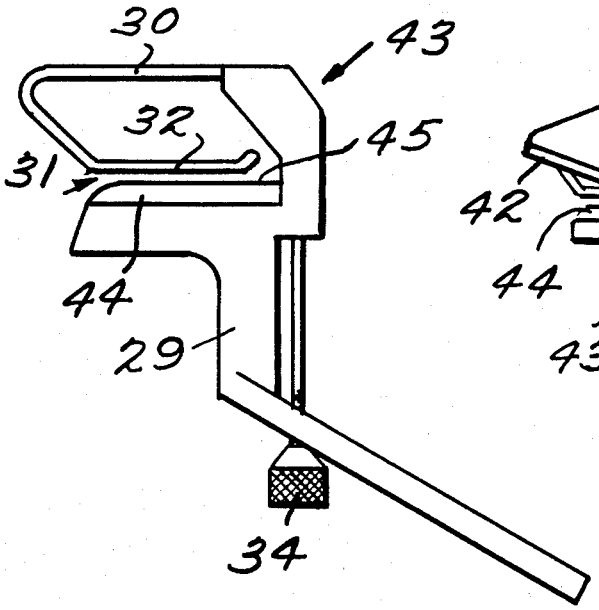
FIG. 5 is a side view of a combined cutter/clamp utilizable as a left side weft trimming and holding structure for the apparatus of FIG. 4.
Figure 6:
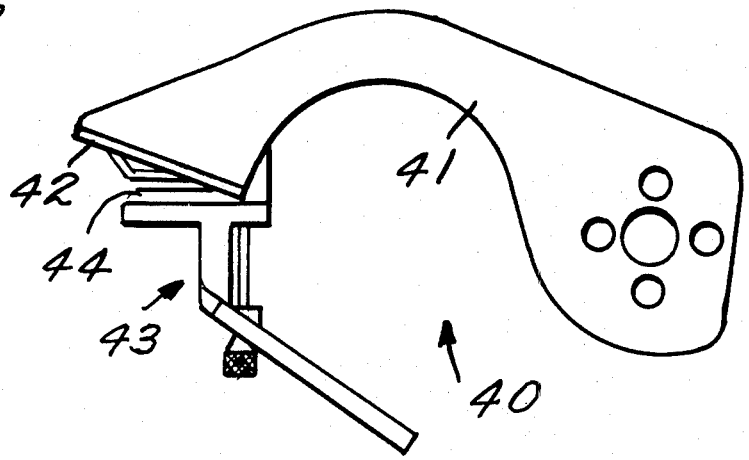
FIG. 6 shows the combined clamp/cutter of FIG. 5 in operative association with a rotatable cutting blade.

The structure 40 (see FIG. 6) includes the pivotal cutting mechanism 41 having blade 42 (see FIG. 6) which cooperates with a modified clamp arrangement 43 (see FIG. 5 in particular). The modified clamp 43 closely resembles the clamp 28 illustrated in FIG. 3, as indicated by the mostly corresponding reference numerals, except that in the FIG. 5 clamp a carbide cutting blade 44, with cutting edge 45, is imbedded in clamp 43 alongside arcuate nip surface 33. While the wire 30 performs its normal clamping functions, when the blade 42 of the cutting mechanism 41 is moved downwardly about the pivot axis in FIG. 6, the weft is severed by cooperation of the blades 42, 44.

At the right side of the loom of FIG. 4, in one embodiment of the invention shown more particularly in FIG. 7, conventional filling detector 23 and stretch nozzle 50 occupy their usual positions relative to the right end of reed 11. Between them, replacing the short leno reed section 22 of FIG. 2, is support member 52, which provides mounting positions for the filling detector and stretch nozzle and also provides the space represented by aperture 51. Filling yarn clamp 48, fixed to the right temple support, passes into and out of aperture 51 as the reed and its attachments reciprocate forward and backward with the insertion of each filling yarn.

In the FIG. 7 embodiment, more clearly shown in FIG. 8, the filling detector 23 is the same as in the prior art. Support member 52, preferably of stainless steel, has, when viewed from right to left in FIG. 7, the same silhouette, generally related to their common support functions, as that of the frame of conventional short leno reed section 22. As with leno reed section 22, the top of support member 52 is attached to the end of reed 11 with a conventional reed clamp (not shown), while its base is fixed in the lay. It is tapped with holes C and D to be interchangeable with the holes in reed section 22 as support points for the attachment of filling detector 23 and stretch nozzle 50.

More specifically, as may best be seen with the aid of the dotted lines in FIG. 7, the left edge of support member 52 is, when view frontally, a straight line. From either side, however and specifically as seen in FIG. 8 from the right side, it is apparent that the side-to-side silhouette of support member 52 is inherited from that of standard Ruti leno reed section 22, which silhouettes are associated with the ready interchangeability of section 22 and support 52 on the machine, and more basically with the conventional positioning of filling detector 23, reed section 22, and stretch nozzle 24 on the loom.

Front-to-back rectangular aperture 51 is best seen diagrammatically in FIG. 7. Aperture 51 is preferably 4 to 5 mm wide but may be wider, but generally only wit accompanying undesirable increase in the weight support member 52 and in filling yarn waste. To insure free operation of clamping mechanism 48, aperture 51 should preferably be about 27 mm high, but with extremely careful aligning of the clamp it may be as little as 20 mm. The upper limit on its height is set by the positions of holes C and D. It will be noted that aperture 51 in support member 52 is bounded on its left by a 3-mm wide strip overlapped by the conventional Ruti filling detector 23. Thus support member 52 is preferably at least 7 mm wide, more preferably 8 mm. additional width being possible, but at the expense of adding to the weight and the filling yarn waste.

In the FIG. 7 embodiment, stretch nozzle 50 is similar to conventional stretch nozzle 24, except that stretch nozzle 50 does not have the 3-mm overlap of the leno reed section which gives stretch nozzle 24 an L-shaped horizontal cross-section. In other words, where nozzle 24 may be made from 10 mm wide by 16 mm deep stock shaped by removal of a 3-mm wide × 8-mm deep cutout along the length of its left rear vertical edge, stretch nozzle 50 may be made from stock 7 mm wide by 16 mm deep, and the final nozzle remains rectangular in horizontal cross-section, as may be seen more clearly in FIG. 8, it being otherwise like nozzle 24 in its functional parts.

Alternatively, if desired, stretch nozzle 50 may be made by grinding away all of the left-side portion of commercial stretch nozzle 24 which normally overlaps leno reed section 22, or optionally by grinding away only those portions of the overlap adjoining the right edge of aperture 51 which may be found to interfere with the free movement of clamping mechanism 48. These alternatives have no recognized special merit except possible temporary convenience, however.

During picking, the end of the weft yarn F extends across aperture 51 in support member 52, between filling detector 23 and stretch nozzle 50. As the lay moves back from front center away from the clamp 48, the pick is retained in tension by the clamp. The yarn is held by the clamp 48 until enough repetitions occur, forcing successive picks to migrate through and exit the nip of the clamp 48. At any one time the clamp 48 is holding several picks. This ensures proper weaving at the fabric selvage by maintaining a good yarn tension on each pick over a period of time, beginning slightly before beat-up and continuing until several picks later when the earlier pick has been forced forward to the point where it exits the nip. With the yarn being held tight over a period of time, the fabric edge is woven tightly without looseness or kinks, and without the necessity of the outer leno yarns. By such a structure also, the excessive amount of waste fringe inherent in conventional air jet looms (see FIG. 2) is eliminated. On the conventional Ruti L5000 air jet loom, if the waste fringe is shortened substantially below 60–65 millimeters in length, the outside leno yarns weave improperly and create a quality problem and possible loom stoppage. This is avoided according to the present invention, wherein, depending on style, each pick is shortened about 25–32 mm on the right side.

Figure 9:
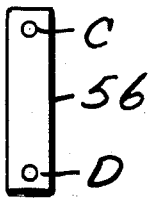
FIG. 9 is a right side view of a yarn pusher strip which may replace the stretch nozzle in FIG. 8, and FIG. 9*a* a view of two modifications of this strip.

Some fabric styles do not require the extra tensioning provided on the right side of the loom by stretch nozzle 50, in the embodiment of FIG. 7. If the stretch nozzle is not utilized, however, something else must be provided in its place to help push the filling yarns into clamp 48. A pusher means, such as the metal strip 56 shown in FIG. 9, is provided in a further embodiment of the invention. This strip, which typically may be about 1 mm thick, 10 mm wide and 50 mm high, is mounted by means of bolts 59 through its untapped holes C and D to support member 52, in place of stretch nozzle 50 (see FIGS. 7 and 8). Suction nozzle 12 tensions the filling yarns while pusher strip 56 pushes the yarns one-by-one into, and eventually through, clamping means 48.

Figure 9A:
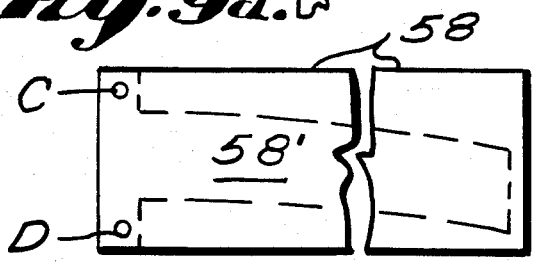

Other fabric styles require tensioning slightly greater than that provided by the suction nozzle 12, yet less than the full tensioning effect of the stretch nozzle 50. In such cases, the pusher structure 56 may be elongated toward the rear of the loom to form both a pusher and a valve. As the reed 11 advances, the valve progressively closes off the elongated suction nozzle 12. This increases the suction on the yarn as the open area of the suction nozzle is reduced by the valve. The valve may be rectangular in shape, as indicated by structure 58 in FIG. 9*a*, or contoured according to the arc of travel of the lay versus the shape of the suction nozzle 12 (see the valve 58' defined by the dotted lines in FIG. 9a). Depending upon the stiffness of the valves 58 and 58' material, a guide bracket may or may not be required at the rear of the valve. Typically, the elongated pusher strip 58 may be about 180 mm wide (i.e., toward the rear) and about 50 mm high.

The preferred clamping means 48 for utilization on the right-hand side of the loom is illustrated most clearly in FIGS. 10 and 11. Components of the clamping means 48 in common with the conventional Ruti left-hand side clamp 28 illustrated in FIG. 3 are shown by the same reference numerals in FIGS. 10 and 11. It should be noted, however, that clamping means 48 is employed in an inverted position, compared to the position of the left cutter clamp 43 of the invention and of the Ruti clamp 28. Also, clamp body 60 is different from clamp body 29, portions of the latter having been significantly milled away in two areas 61 and 62 for proper clearance. Area 62 is ground down to permit alignment of clamp 48 close to the right-hand temple support such that surface 33 will be horizontal as it approaches filling yarn F, the space available behind the temple support and temple table being very restricted. Area 61 is ground down at points subject to contact with the portions of filling detector 23, support member 52, and stretch nozzle 50 adjoining the top of aperture 51, as the clamp is introduced into the aperture with each forward cycle of the reed and its attachments. As indicated by the dual markings at 61, milling is in two directions, front-to-back into the vertical portion of clamp body 60, and laterally into slanting attachment leg 35 where it joins the vertical portion of the clamp. Also, the spring finger portion of the spring wire 30 cooperating with the surface 33 to form the nip 31 takes the form illustrated by reference numeral 63 in FIG. 10, being substantially shortened (e.g., by 3–4 millimeters) compared to the spring finger 32 in FIG. 3. This provides additional clearance which also prevents bunching-up as the yarns exit the clamp, so that yarn entanglement is avoided.

The spring finger 63 also has a different bend from that of the finger 32 so that the pressure on the yarn is greater at the entrance into the nip 31. That is, the angle J' —between spring finger 63 and an imaginary line I perpendicular to base arcuate surface 33 and extending from the opposite side of surface 33 from finger 63—is slightly less than 90° (e.g., about 87°–89°), whereas the angle J—see FIG. 3—is in most instances 90°, or slightly greater than 90°, as the springs are received from the manufacturer. By the angle J' being made less than 90°, adequate tension is maintained at the entrance to the nip of the clamp without the nut 34 having to be tightened to the degree that excessive pressure is applied near the exit from the nip. Without the provision of the angle J' as defined, the tension at the entrance to the nip 31 is inadequate, which sometimes results in clamp failure in that the clamp does not retain the filling F as the reed 11 moves back front center. The filling, being free to move, can fold back into the shed as it opens and become woven into the fabric, creating a defect.

A mounting bracket 65 is illustrated in FIG. 11, the bracket having a top surface 66 with openings 67 formed therein for receipt of mounting bolts 68 passing through openings in the mounting portion 35 of the clamp 48 to mount clamp 48 to the upper surface 66. A mounting slot 69 is formed at the opposite portion of the bracket 65 for mounting on the support for right temple 14. The bracket 65 mounts the clamping means 48 so that it extends from above into aperture 51 in support member 52, between filling detector 23 and stretch nozzle 50 or pusher strip 56.

Since the outer leno yarns have been eliminated according to the present invention, a mechanism should be provided associated with fringe cutter 16 to remove the trimmed fringe. This is preferably accomplished by utilizing a vacuum nozzle 70 adjacent the fringe cutter 16 which is also connected to the suction source 13. The nozzle 70, in addition to removing the cut fringe, also straightens and tensions the yarn fringe for ease of cutting.

Certain other fabric styles may profit from another embodiment of the invention, comprising a combination where both stretch nozzle 50 and valve 58 or 58' are used together, the valve being screwed to the right side of the stretch nozzle rather than to support member 52. In this instance the pushing effect on the yarn is not needed, this already being supplied by the stretch nozzle. The active effect is rather that with each forward movement of the reed, and the consequent closure of suction nozzle 12, an increased surge or pulse of suction is produced at vacuum nozzle 70. This further helps to straighten and tension the yarn for the action of fringe cutter 16.

The operation of the apparatus according to the present invention is as follows:

As each filling yarn F is propelled by main jet 10 across reed 11 and attracted by vacuum nozzle 12, the entire nozzle, reed, jet system is reciprocated in dimension A, moving the yarn F toward the cutter-clamp 40 and clamp 48. The stretch nozzle 50 or pusher strip 56 at the right end of the loom facilitates movement of the filling yarn F into the nip 31 of the right clamping means 48, while at the left end the filling yarn F moves into the nip 31 of the left clamp 43. The cutter 41 is pivoted downwardly so that the blades 42, 44 cooperate to sever the filling yarn F at the left, and the lay is then moved in dimension A opposite the direction B to return to its original position. A plurality of picks are held by the clamps 43, 48, until enough repetitions occur to force the yarn thereafter to migrate through and exit the nips of the clamps 43, 48, so that the fabric is woven tightly without looseness or kinks. Ultimately the right end of the fabric is trimmed by the fringe cutter 16, and the final fabric is produced.

While the invention has been herein shown and described in what is presently conceived to be the most practical and preferred embodiment thereof, it will be apparent to those of ordinary skill in the art that many modifications may be made thereof within the scope of the invention. In particular, although the invention is described as applied to the Ruti L5000 loom, it is believed readily applicable to other air jet looms of generally similar construction. Thus the invention scope is to be accorded the broadest interpretation of the appended claims so as to encompass all equivalent structures and methods.

What is claimed is:

1. In an air jet loom for weaving fabric, including a main jet, a reed, a suction source mounted on the opposite side of the reed from the main jet, temples, a fringe cutter mounted on the same side of the fabric being woven as the suction source, and downstream of the temples in the directin of woven fabric movement, and a filling detector between the reed and suction source: a filling fringe waste reduction means for eliminating outer or auxiliary leno selvage waste from both sides of favric being woven and avoiding the utilization of outer leno yarns, said waste reduction means including:

a filling yarn mechanical clamping means operatively disposed between said filling detector and said suction source for holding filling yarns from said main jet; and a second suction source mounted adjacent and exterior of said fringe cutter for removing fabric ends cut by said fringe cutter.

2. In an air jet loom as recited in claim 1 wherein said waste reduction means further includes clamping-cutter means disposed on the same side of the fabric being woven as the main jet, said clamping-cutter means consisting essentially of a spring clamp including a spring finger and a base, said base including a cutting edge facing in the direction of said spring finger, and a pivotally mounted cutting blade mounted for pivotal movement to cooperate with said base cutting edge to cut the filling yarn from the main jet, said spring clamp and cutting blade located upstream of the temples in the direction of woven fabric movement.

3. In an air jet loom as recited in claims 1 or 2, said filling yarn clamping means comprising a spring clamp including a spring finger, and a base having a laterally arcuate surface for cooperation with said spring finger to define a nip; said spring finger making an angle of less than 90° with an imaginary line perpendicular to said base surface and extending from the opposite side of said base from the spring finger.

4. In an air jet loom as recited in claim 3, further comprising a bracket for mounting said filling yarn clamping means to a temple so that said filling yarn clamping means is operatively disposed between said filling detector and said suction source with said base located vertically above said spring finger.

5. In an air jet loom as recited in claim 3 a stretch nozzle, and a support for mounting said stretch nozzle to said filling detector with an aperture for receipt of said filling yarn clamping means between said filling detector and said stretch nozzle, and said filling detector on the opposite side of said stretch nozzle from said suction source.

6. In an air jet loom as recited in claim 3 pushing means for pushing a filling end into operative association with said filling yarn clamping means, said pushing means comprising a strip of material, and a support for mounting said strip of material to said filling detector with an aperture provided between said strip and said filling detector, with said filling detector on the opposite side of said strip from said suction source.

7. In an air jet loom as recited in claim 1 a stretch nozzle, and a support for mounting said stretch nozzle to said filling detector with an aperture for receipt of said filling yarn clamping means between said filling detector and said stretch nozzle, and said filling detector on the opposite side of said stretch nozzle from said suction source.

8. In an air jet loom as recited in claim 1 pushing means for pushing a filling end into operative association with said filling yarn clamping means, said pushing means comprising a strip of material, and a support for mounting said strip of material to said filling detector with an aperture provided between said strip and said filling detector, with said filling detector on the opposite side of said strip from said suction source.

9. In an air jet loom as recited in claim 8 said strip being elongated and comprising valve means for valving said suction source to increase the suction on the filling yarn provided by said suction source.

10. In an air jet loom for weaving fabric, including a main jet, a reed, a suction source mounted on the opposite side of the reed from the main jet, and a mechanical clamping means mounted adjacent said suction source: a filling detector mounted on the end of the reed adjacent said suction source; pushing means to facilitate pushing of the filling yarn end into said clamping means; and a support for mounting said pushing means to said filling detector so that an aperture is provided between said filling detector and said pushing means for receipt of said clamping means.

11. In an air jet loom as recited in claim 10 wherein said pushing means comprising a stretch nozzle.

12. In an air jet loom as recited in claims 10 or 11 wherein said pushing means comprising a strip of material.

13. In an air jet loom as recited in claim 12 said strip being elongated and comprising valve means for valving said suction source to increase the suction on the filling yarn provided by said suction source.

14. A method of minimizing outer or auxiliary leno selvage from both sides of fabric being woven on an air jet loom without utilizing outer leno yarns, comprising the steps of: effecting combined mechanical clamping and cutting of the filling yarn at the loom left hand side immediately adjacent the left hand edge of the fabric being woven so that acceptable fringe length, without subsequent trimming, is provided on the left hand edge of the fabric being woven; and mechanically clamping the filling yarn ends at the right hand side of the loom to provide adequate yarn tension on each filling yarn over a period of time, beginning slightly before beatup and continuing until several picks later, so that the fabric edge is woven tightly without looseness or kinks.

15. A method as recited in claim 14 wherein the loom has temples, and wherein the mechanical clamping on the right-hand side of the loom is practiced before the temples in the direction of fabric movement; and comprising the further step of trimming the fringe at the right-hand side of the fabric downsteam of the temples, and tensioning the fringe for trimming and removing the fringe by providing a vacuum action on the fringe as it is being trimmed.

16. In an air jet loom for weaving fabric, including a main jet, a reed, a suction source on the opposite side of the read from the main jet, and temples: a waste reduction means for eliminating outer or auxiliary selvage from the left-hand side of the fabric being woven and avoiding the utilization of outer leno yarns, said waste reduction means including a clamping-cutter means disposed on the same side of the fabric being woven as the main jet, said clampingcutter means consisting essentially of a spring clamp including a spring finger and a base, said base including a cutting edge facing in the direction of said spring finger, and a pivotally mounted cutting blade mounted for pivotal movement to cooperate with said base cutting edge to cut the filling yarn from the main jet, said spring clamp and cutting blade located upstream of the temples in the direction of woven fabric and located adjacent the edge of the fabric so that an acceptable fringe length is provided, and further fringe trimming is unncessary.

17. In an air jet loom as recited in claims 2 or 16, wherein said spring clamp further comprises: means for operatively connecting said spring finger to said base, said connecting means comprising a rigid member extending generally transverse to said base, and a spring wire body cantilevered to said rigid member; said spring finger comprising part of said spring wire body and having a terminating end portion thereof, said end portion being adjacent said rigid member, but spaced from said rigid member along the length of said base a distance sufficient to allow passage of a filling yarn diameter therethrough.

* * * * *